United States Patent [19]

Johnson

[11] 4,443,899

[45] Apr. 24, 1984

[54] VACUUM CLEANING SYSTEM FOR A THERAPEUTIC TUB

[75] Inventor: Bruce R. Johnson, Petaluma, Calif.

[73] Assignee: Jandy Industries, San Rafael, Calif.

[21] Appl. No.: 451,417

[22] Filed: Dec. 20, 1982

[51] Int. Cl.[3] ..... E04H 3/20; B08B 9/08

[52] U.S. Cl. ..... 4/490; 4/559; 15/1.7; 15/409

[58] Field of Search ..... 15/1.7, 409; 4/490, 4/492, 538, 559

[56] References Cited

U.S. PATENT DOCUMENTS 3,471,884 10/1969 Wright ..... 15/1.7 X
3,481,470 12/1969 Valois ..... 15/1.7 X
4,119,686 10/1978 Conger ..... 4/559 X
4,406,026 9/1983 Steimle ..... 4/492

*Primary Examiner*—Chris K. Moore
*Attorney, Agent, or Firm*—Melvin R. Stidham

[57] ABSTRACT

A vacuum cleaning system for a therapeutic tub that utilizes an aerating intake for jet nozzles located around the tub. A vacuum hose is connected to the air intake so that its capacity to draw in air is utilized to draw in spa water and expell it at the jet nozzles. A vacuum head, which is connected at the other end of the hose, is moved along the bottom and sides of the tub to draw in the water, as well as leaves and debris, which are trapped at a filter screen.

4 Claims, 1 Drawing Figure

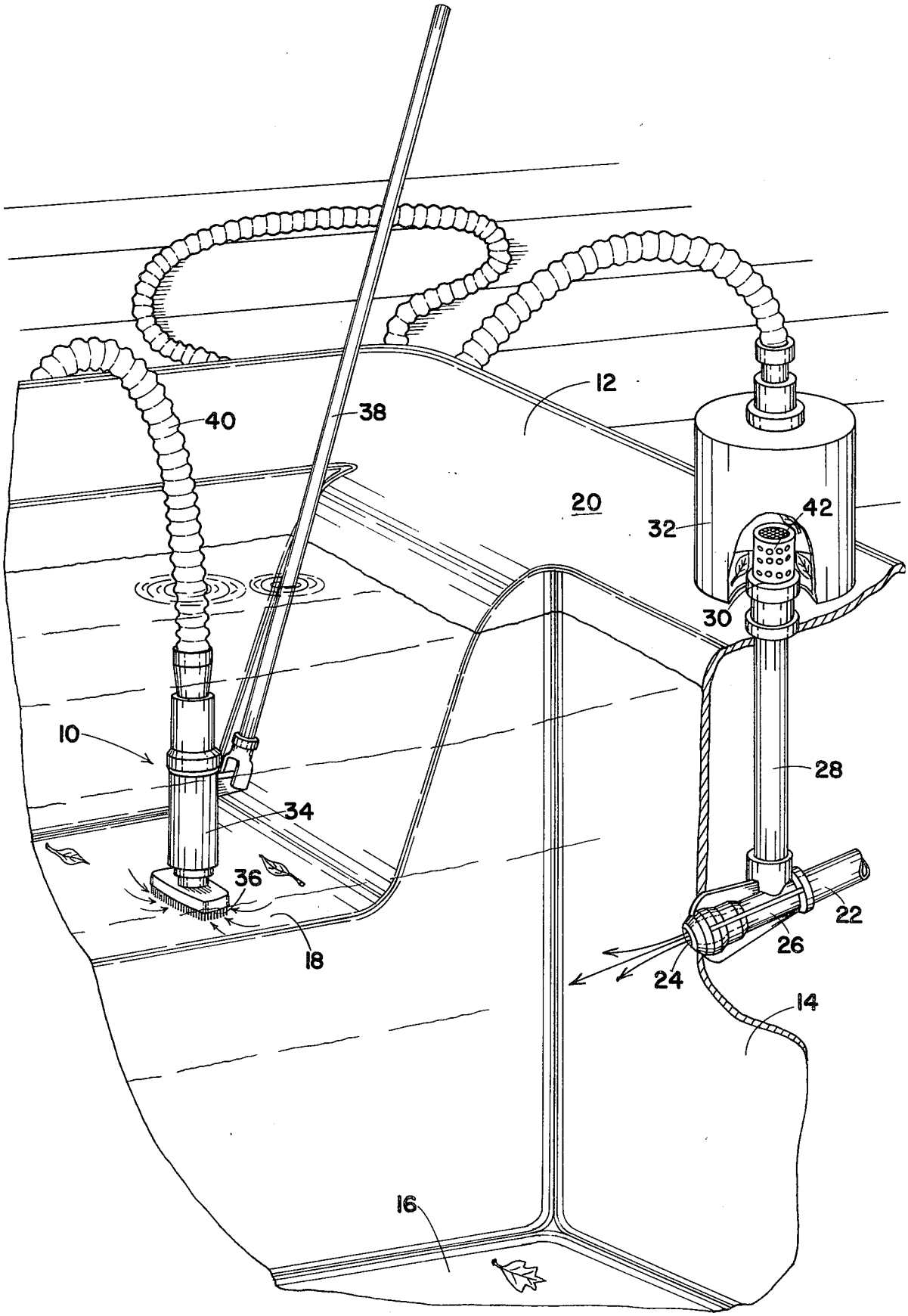
12
40
38
20
42
32
30
10
28
34
36
22
26
18
24
14
16

VACUUM CLEANING SYSTEM FOR A THERAPEUTIC TUB

BACKGROUND OF THE INVENTION

Therapeutic tubs, commonly called "spas," have become increasingly popular in recent years. Certain of such spas are formed of a relatively rigid plastic, such as Fiberglas, and have a plurality of nozzles mounted in the walls to project high velocity, massaging streams of water against occupants of the tub. As in the case of swimming pools, such spas require periodic cleaning, and it would be highly desirable to be able to effect such cleaning by a vacuuming device. However, there is no convenient way of attaching a vacuum hose to the suction side of the spa circulating pump.

OBJECTS OF THE INVENTION

It is an object of this invention to provide a vacuum system for a therapeutic tub.

It is a further object of this invention to provide a vacuum cleaning system that utilizes an available source of vacuum in a therapeutic tub.

Other objects and advantages of this invention will become apparent from the description to follow, particularly when read in conjunction with the accompanying drawing.

SUMMARY OF THE INVENTION

In many therapeutic tubs of plastic or the like a water circulation conduit extends around the tub terminating at various points along its length in high velocity nozzles that jet into the tub. An upright air line opens into the conduit to draw in air from above the water level by venturi action of a restriction in the conduit. The spa cleaner of this invention includes a flexible hose, one end of which is placed over the air intake opening to seal around it, whereby water, dirt and debris are picked up at a vacuum head with the dirt and debris to be collected at a filter located somewhere between the vacuum head intake and the air intake. A handle may be provided to manipulate the vacuum head.

BRIEF DESCRIPTION OF THE DRAWING

The drawing is a view in perspective, partially broken away showing a portion of the spa water circulating system with the vacuum cleaning system of this invention.

DESCRIPTION OF A PREFERRED EMBODIMENT

Referring now to the drawing with greater particularity, the vacuum cleaning system 10 of this invention is designed for use with a therapeutic tub or spa 12, which is commonly made of a rigid plastic, such as Fiberglas. Such tubs are usually formed in one piece with side walls 14, a bottom 16 and even benches 18 and top flanges or rails 20.

Such spas also include water circulation conduits 22, which terminate in nozzles 24, each of which projects a jet of aerated water at high velocity into the pool to provide a massaging effect on those against whom it impinges. A high velocity venturi restriction 26 draws in a regulated amount of air through an upright air duct 28 that opens at 30 above the horizontal rail 20.

In the vacuum cleaning system 10 of this invention, a converter receptacle 32 is placed over the air intake 30 to seal against the horizontal rail 20, sealing around the air intake.

A vacuum head 34 comprising little more than a hollow body with an intake head 36 is manipulated by a handle 38 to clean the surfaces of the spa or therapeutic tub 12, whereby spa water, as well as leaves, sand and other foreign particles are drawn into the head 34 by means of the vacuum pulling through a flexible hosing 40 from the converter receptacle 32.

At some convenient location in the vacuum system, or in the head 39 or the converter receptacle 32, is placed a filter trap to catch the leaves, dirt and other debris. In the drawing a filter cap 42 is connected into the air intake 30 so that such debris is trapped and collected in the converter receptacle.

In operation, the available air intake through which air is drawn in by the low pressure area in the venturi is converted into a vacuum source that draws the water and foreign particles through the hose 42 to the collector head, wherein the leaves and foreign particles are entrapped and the water simply continues on through the air tube 28 to exit through the nozzle 24.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A vacuum cleaning system for a therapeutic tub;
- said tub having a water conduit terminating in at least one jet nozzle mounted in a side wall thereof;
- a restriction in said conduit to produce a high velocity, low pressure zone;
- an upright air duct connected to said conduit at said low pressure zone; and
- means forming an air intake opening at the upper end of said air duct;
- said vacuum cleaning system comprising:
- a vacuum head to be moved over the inner surface of said therapeutic tub;
- an outlet port in said vacuum head;
- means forming a flow passage from the bottom of said head to said outlet port;
- a hose connected at one end thereof to said vacuum head outlet port; and
- means on the other end of said hose to seal around said upper end of the air duct.

2. The vacuum cleaning system defined by claim 1 wherein:
- there is a generally horizontal ledge around the upper edge of said tub and said upright air duct extend through said ledge with said air intake thereabove; and including:
- a receptacle on said other end of the hose;
- means forming an opening in the bottom of said receptacle; and
- a sealing surface around said opening to engage said horizontal ledge.

3. The vacuum cleaning system defined by claim 1 including:
- an elongated handle pivotally connected to said vacuum head.

4. The vacuum cleaning system defined by claim 1 including:
- a filter located between said vacuum head and said air intake opening.

* * * * *